US006270425B1

(12) United States Patent
Dyer

(10) Patent No.: US 6,270,425 B1
(45) Date of Patent: Aug. 7, 2001

(54) DEVICE FOR ALTERING THE ANGLE BETWEEN THE SHAFT AND THE HEAD OF A GOLF CLUB

(75) Inventor: Alonzo J. Dyer, Encinitas, CA (US)

(73) Assignee: The Nirvana Group, L.L.C., San Marcos, CA (US)

( * ) Notice: Subject to any disclaimer, the term of this patent is extended or adjusted under 35 U.S.C. 154(b) by 0 days.

(21) Appl. No.: 09/511,135

(22) Filed: Feb. 23, 2000

(51) Int. Cl.[7] ..... A63B 53/02
(52) U.S. Cl. ..... 473/307; 473/308; 473/313
(58) Field of Search ..... 473/244, 245, 473/246, 247, 248, 305, 306, 307, 308, 309, 310, 311, 312, 313, 314, 315, 282, 131, 324

(56) References Cited

U.S. PATENT DOCUMENTS 2,018,897 * 10/1935 Reach .
2,067,556 * 1/1937 Wettlaufer .
2,146,321 * 2/1939 Wettlaufer .
2,219,670 * 10/1940 Wettlaufer .
2,425,808 * 8/1947 Jakosky .
4,073,492 * 2/1978 Taylor .
4,948,132 * 8/1990 Wharton .
5,540,435 * 7/1996 Kawasaki .
5,851,155 * 12/1998 Wood .
5,951,411 * 9/1999 Wood .

* cited by examiner

*Primary Examiner*—Sebastiano Passaniti
(74) *Attorney, Agent, or Firm*—Leonard Tachner

(57) ABSTRACT

A device for altering the angle between the shaft and the head of a golf club. The preferred embodiment of the invention utilizes a plurality of inserts which are configured to be inserted into a tapered hole in the golf club head for receiving a shaft or a hosel for mating with the shaft. Each such insert is designed to provide a different angle between head and shaft so that the golfer merely selects one of the plurality of inserts which will be best for his or her hitting accuracy. The inserts are positioned in the club head in such a way as to create a swaging of the insert into the club head and the insert onto the shaft tip. Swaging is the interference fit of two components with two or more surfaces that are forced together in a locking condition, for instance a tapered pin into a tapered hole. A swaging screw is utilized to drive the insert into a tapered swage condition with the club head and thus squeeze onto the shaft to ensure a strong bond without utilizing an adhesive. The disclosed embodiment relates to a golf club putter, but other golf clubs, such as metalwood head golf clubs would employ the invention as well.

9 Claims, 5 Drawing Sheets

DEVICE FOR ALTERING THE ANGLE BETWEEN THE SHAFT AND THE HEAD OF A GOLF CLUB

BACKGROUND OF THE INVENTION

1. FIELD OF THE INVENTION

The present invention relates generally to the field of golf clubs and more specifically, to golf clubs wherein an insert is received in the golf club head and mates with the golf club shaft and wherein the insert may be removed and replaced to provide different relative angles between the head and the shaft.

2. BACKGROUND ART

An important factor in the performance of a golfer on the course is the geometry of the clubs used by the golfer. Depending upon the golfer's swing mechanics and his or her stance and body dimensions, the angle between a golf club shaft and the ball hitting head to which it is attached can have a significant degree of variation and such variation can drastically affect the accuracy of ball impact and thus significantly impact a golfer's score. Perhaps no golf club has more impact on overall score than the putter. In a typical round of golf of eighteen holes, about half the score is attributable to putting strokes. Thus it would not be unusual for a golfer who scores an 80 on a par 72 course to have 40 or more putting strokes as part of the total. Thus, the selection of the most appropriate angle between shaft and head is probably most important in the putter. Yet the vast majority of conventional golf club putters do not provide any easy way of adjusting the angle between shaft and head without bending the hosel or neck of the putter. Once a golfer purchases a conventional putter, he or she cannot alter the lie angle to optimize putting performance. Even though some golf club manufacturers provide some form of customizing to each golfer, once the clubs are in the golfer's bag, there can be no further changes.

It would be highly advantageous if there were a putter designed to permit changes to be made to its lie angle as the golfer uses it and determines which angle is best for his or her particular putting technique. In this manner, a golfer could readily alter the angle between head and shaft between rounds until he or she discovered which such angle produced the most accurate putting stroke. Moreover, as the golfer changes his or her putting technique due to minor aches and pains, more serious medical conditions, or just simply by virtue of choice, the putter can be then modified to produce a more suitable lie angle for the new putting technique. Unfortunately, the Applicants know of no existing golf club putter which provides for easy and convenient modification of lie angle by simple mechanical adjustment at any time the golfer wishes to alter his or her putting stroke or simply to experiment for achieving greater accuracy in the most significant part of the game.

SUMMARY OF THE INVENTION

The present invention provides a simple and convenient device for altering the angle between the shaft and the head of a golf club embodied here as a putter. The preferred embodiment of the invention utilizes a plurality of inserts which are configured to be inserted into a tapered hole in the golf club head for receiving a shaft or a hosel for mating with the shaft. Each such insert is designed to provide a different angle between head and shaft so that the golfer merely selects one of the plurality of inserts which will be best for his or her putting accuracy.

There are specific mechanical principles involved in positioning the inserts into a club head that make it unique and unlike other golf club patents that alter relationships of the shaft length axis with the club head face geometry. The inserts are positioned in the club head in such a way as to create a swaging of the insert into the club head and the insert onto the shaft tip. Swaging is the interference fit of two components with two or more surfaces that are forced together in a locking condition, for instance a tapered pin into a tapered hole. A swaging screw is utilized to drive the insert into a tapered swage condition with the club head and thus squeeze onto the shaft to ensure a strong bond without utilizing an adhesive. In addition, the shaft tip has a designed polarizing area that engages with the insert so as to create a specific relationship between the shaft and the insert making it a subassembly ready to fit into the club head. In turn, the insert has a specific polarizing feature that engages the insert and shaft subassembly into the club head to form a specific shaft to club head relationship and is force locked into position by the swage screw to provide a specific face angle and lie angle of the golf club.

OBJECTS OF THE INVENTION

It is therefore a principal object of the present invention to provide a golf club having an insert mechanism designed to provide alternative angles between the golf club shaft and the golf club head by simple removal and replacement of the insert mechanism.

It is another object of the present invention to provide a golf club putter having a head configured for receiving any one of a plurality of inserts, each said insert providing a different angular relation between the golf club shaft and the golf club head.

It is yet another object of the invention to provide a putter having selectable lie angles in accordance with the geometry of a swagable insert device received in the putter head.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
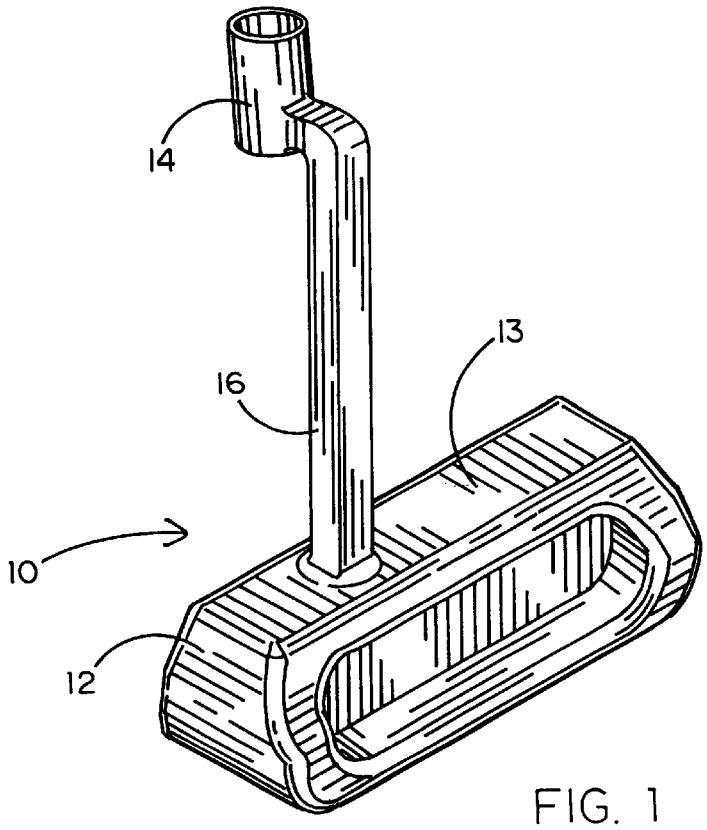
FIG. 1 is a three-dimensional view of a putter head embodying the present invention.
Figure 2:
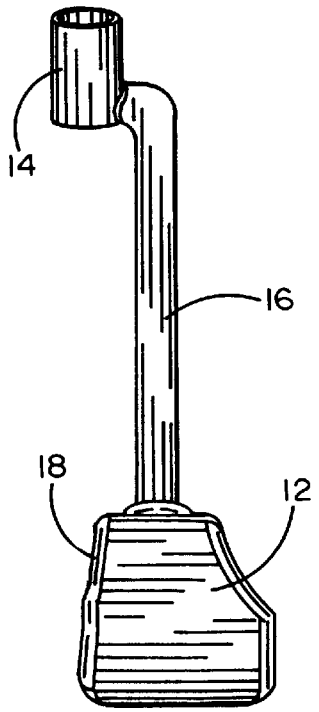
FIG. 2 is a heel view of the putter head.
Figure 3:
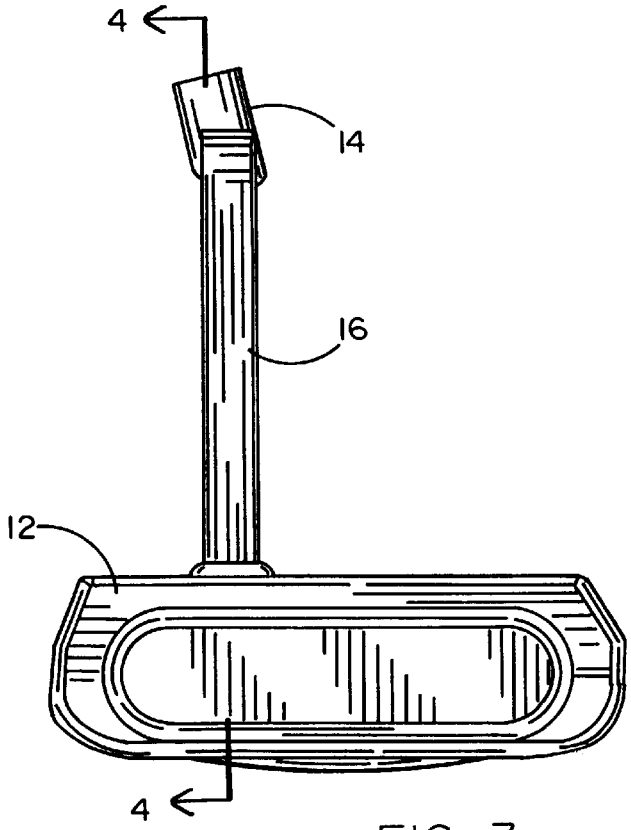
FIG. 3 is a back view of the putter head.
Figure 4:
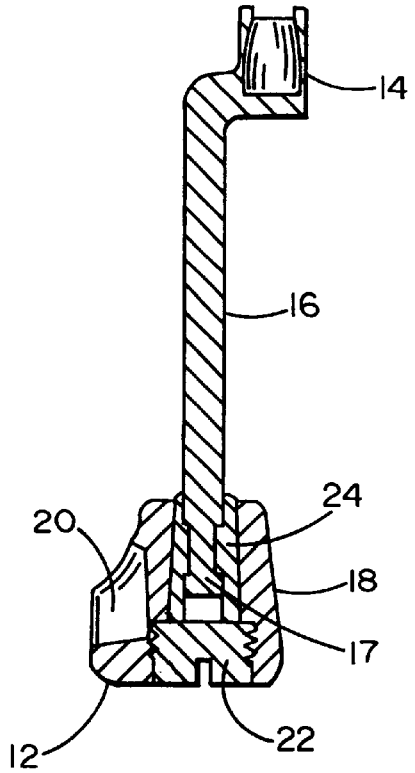
FIG. 4 is a toe cross-sectional view of the putter head.
Figure 5:
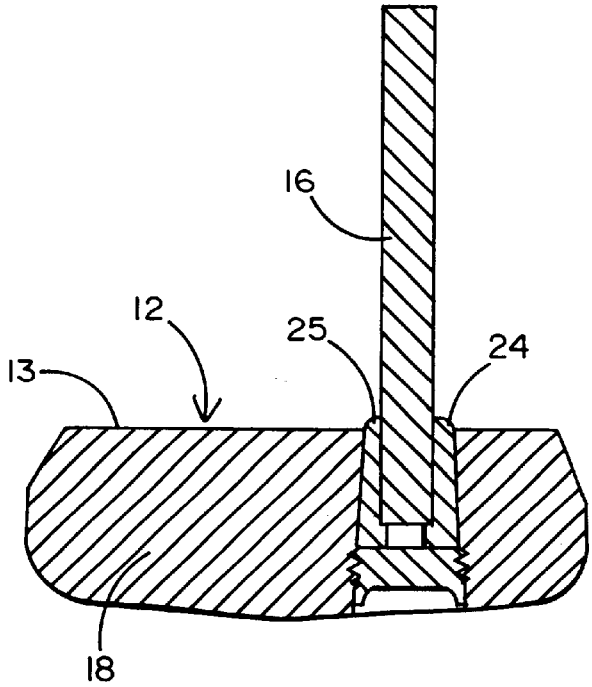
FIG. 5 is a front cross-sectional view of the putter head.
Figure 7:
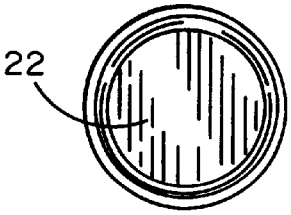
FIGS. 7–10 are different views of the swage screw of the invention.
Figure 8:
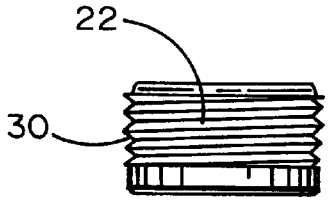
Figure 9:
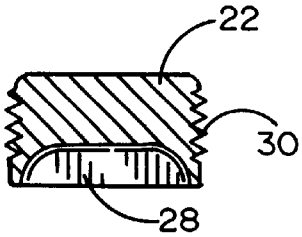
Figure 10:
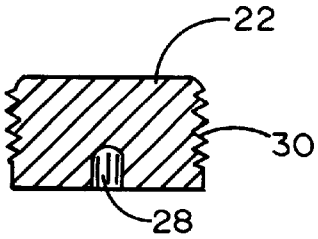
Figure 6:
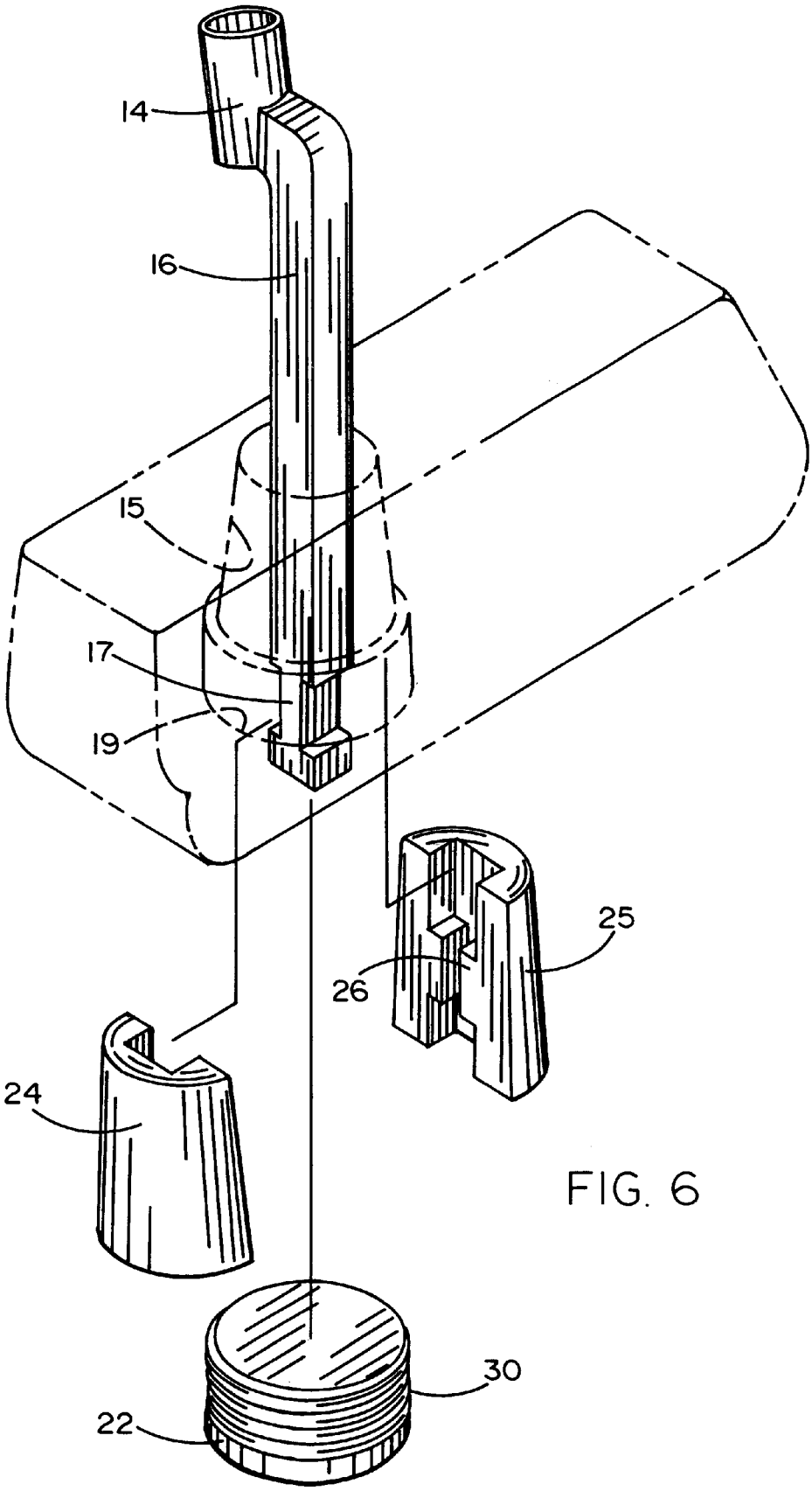
FIG. 6 is an exploded view of the angle control components of the invention.

Referring to the accompanying figures, it will be seen that a putter head 10 employing the present invention, comprises a ball striking portion 12 having a face 18, a shaft receptacle 14 and a hosel 16 for connecting the shaft (not shown) to the putter head. As seen best in FIGS. 4, 5 and 6, the putter head has a tapered aperture 15 and a threaded recess 19. The hosel 16 extends into the tapered aperture from the upper surface 13 of the ball striking portion 12. The hosel 16 comprises an insert shank 17 which, as seen in FIG. 6, has a reduced lateral dimension over a short portion of the hosel length. The tapered aperture 15 is shaped to receive a pair of insert members 24 and 25 which have generally a semi-conical-frustum configuration and which in combination form a full conical frustum with a hosel slot 26 therebetween. As seen further in FIGS. 4, 5 and 6, the hosel slot 26 is configured to receive the hosel shank 17 and for trapping the shank and thus the entire hosel 16. A swaging screw 22 (see FIGS. 7–10) having a screw driver slot 28 and a threaded radial surface 30, may be threadably secured within threaded recess 19. Because of the tapered configuration of recess 15 and the similarly tapered shape of insert members 24 and 25, when swaging screw 22 is fully threaded into head 10, the insert members are locked into the head and, in turn, lock the hosel 16 between them.

Figure 11:
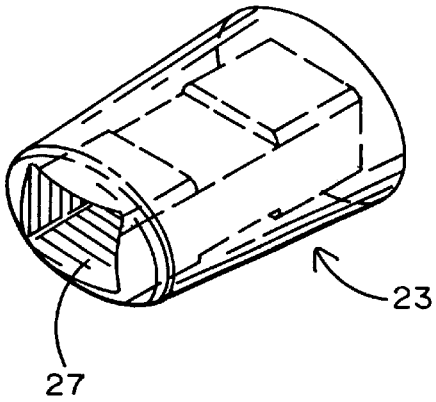
FIGS. 11–14 are three-dimensional views of four different inserts which may be used in the invention.
Figure 12:
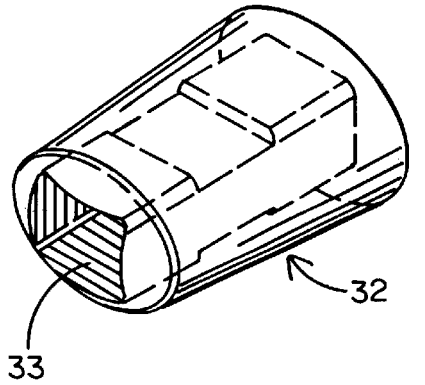
Figure 13:
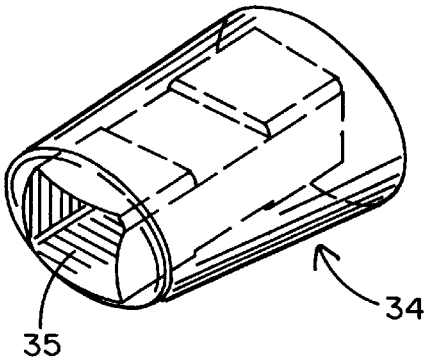
Figure 14:
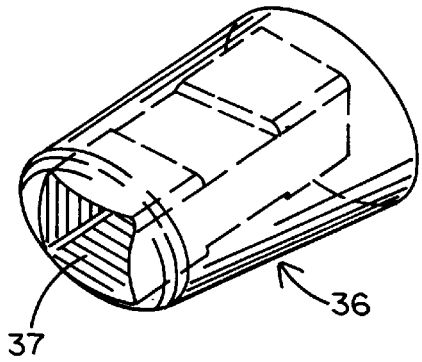
Figure 15:
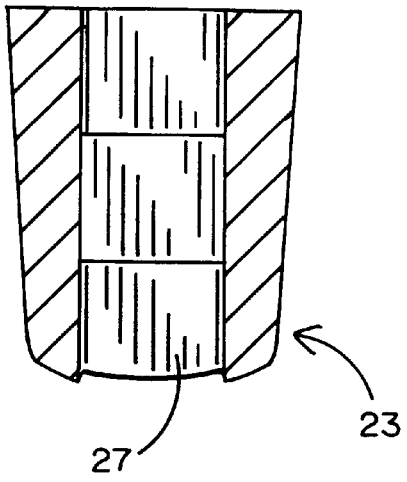
FIGS. 15–18 are cross-sectional views of the four different inserts of FIGS. 11–14.
Figure 16:
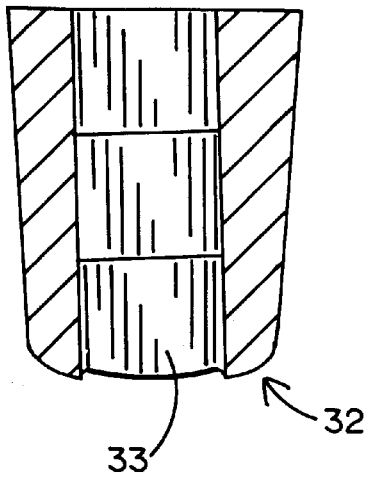
Figure 17:
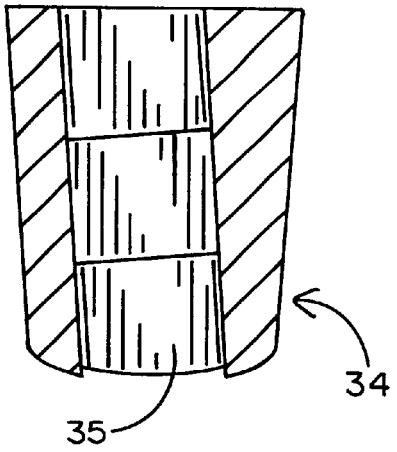
Figure 18:
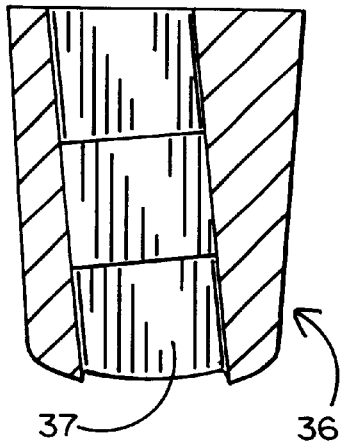

The hosel 16 is not only locked into the head 10, but it is also forced into alignment with the hosel slot 26. In FIG. 6, the insert members 24 and 25, when combined around hosel insert shank 17, form a zero degree insert 23 shown in FIGS. 11 and 15 and having an insert slot or passage 27 which is generally perpendicular to upper surface 13 of the ball striking portion 12. However, because of the uniquely configured swaging insert feature of the invention, zero degree insert 23 may be readily removed and replaced by any one of a plurality of alternative inserts having a modified configuration for altering the angle of the hosel 16 (and thus the shaft) with the ball striking portion 12. By way of illustration, FIGS. 12 and 16 illustrate a two degree insert 32 having an insert slot or passage 33 which is canted by two degrees. FIGS. 13 and 17 illustrate a four degree insert 34 having an insert slot or passage 35 which is canted by four degrees. FIGS. 14 and 18 illustrate a six degree insert 36 having an insert slot or passage 37 which is canted by six degrees. Clearly, the extent to which each such insert slot is canted will determine the resulting angular relationship between the ball striking portion 12 and the hosel 16 (and thus with a shaft).

Based upon the foregoing it will be understood that the lie angle of a putter constructed in accordance with the present invention may be readily altered to a desired extent by simply substituting a corresponding insert having the desired angle of canting. Moreover, it will be observed that removal and replacement of each such insert by another, may be readily accomplished by simply removing the swaging screw 22 and the insert; replacing the insert and reinserting the swaging screw 22 and tightening same. Of course, it will be understood that once the swaging screw 22 is removed, the ball striking portion 12 will be readily raised along hosel 16 thus withdrawing the insert along with the insert shank 17 of the hosel through the tapered recess 15 and the threaded recess 19 so that the insert members 24 and 25 can be separated from the hosel much like that configuration illustrated in FIG. 6. After replacement of the insert, the ball striking portion 12 is lowered along hosel 16 until the new insert is swaged against the tapered recess 15. Insertion and tightening of swaging screw 22 will then secure the new insert and provide a different lie angle putter. It will be understood that the invention disclosed herein is not necessarily limited to golf club putters, but can also be used to alter the lie and face angles for other golf club heads including for example, metalwood heads.

Having thus described a preferred embodiment of the present invention, it being understood that modifications and additions are contemplated for carrying out the objects of the invention, what is claimed is:

1. A golf club head having a ball striking portion and a hosel extending from the ball striking portion and having a shaft receptacle for receiving a shaft, the angle between the hosel and the ball striking portion being alterable to provide any one of a plurality of different angles; the head further comprising:

a tapered aperture in said ball striking portion;

a plurality of tapered inserts each having at least two complimentary members for locking engagement with said hosel;

a swaging screw for swaging said insert into said aperture, said swaging screw being selectably removable from said ball striking portion for removal and replacement of said insert;

said insert having a hosel passage through which said hosel is passed for engagement with said insert said passage being oriented relative to said ball striking member at a selected angle depending upon a desired angle of said head relative to a shaft.

2. The golf club head recited in claim 1 wherein said insert is configured as a conical frustum.

3. The golf club head recited in claim 1 wherein said hosel has an insert shank and said insert has a hosel slot, said shank and said slot being keyed to each other for locking said hosel into said insert.

4. The golf club head recited in claim 1 wherein said plurality of different angles are in the range of zero to at least six degrees.

5. A golf club head having a ball striking portion and a hosel extending from the ball striking portion and having a shaft receptacle for receiving a shaft, the angle between the hosel and the ball striking portion being alterable to provide any one of a plurality of different angles of the head relative to a shaft; the head further comprising:

said ball striking portion having an aperture, said aperture receiving any one of a plurality of removable inserts, each said insert having a slot for locking engagement with said hosel, and a locking device forcefully engaging said any one of said inserts with said hosel, said inserts each having a hosel passage orientated at a different selected angle relative to said ball striking portion for determining a selected one of said different angles of said head relative to a shaft.

6. A golf club putter having a ball striking portion and a hosel extending from the ball striking portion and having a shaft receptacle for receiving a shaft, the angle between the hosel and the ball striking portion being alterable to provide any one of a plurality of different lie angles of the putter; the putter further comprising:

a tapered aperture in said ball striking portion;

a plurality of tapered inserts each having at least two complimentary members for locking engagement with said hosel;

a swaging screw for swaging said insert into said aperture, said swaging screw being selectably removable from said ball striking portion for removal and replacement of said insert;

said inserts each having a hosel passage through which said hosel is passed for engagement with said insert, said passage being oriented relative to said ball striking member at a selected angle depending upon a desired lie angle of said putter.

7. The golf club putter recited in claim 6 wherein each said insert is configured as a conical frustum.

8. The golf club putter recited in claim 6 wherein said hosel has an insert shank and each said insert has a hosel slot, said shank and each said slot being keyed to each other for locking said hosel into each said insert.

9. The golf club putter recited in claim 6 wherein said plurality of different lie angles are in the range of zero to at least six degrees.

* * * * *